US006783011B2

(12) United States Patent
Rodrigue

(10) Patent No.: US 6,783,011 B2
(45) Date of Patent: Aug. 31, 2004

(54) MERCHANDISE HANGER

(75) Inventor: Michael Rodrigue, Rancho Cucamonga, CA (US)

(73) Assignee: Bradshaw International, Inc., Rancho Cucamonga, CA (US)

( * ) Notice: Subject to any disclaimer, the term of this patent is extended or adjusted under 35 U.S.C. 154(b) by 0 days.

(21) Appl. No.: 10/233,433

(22) Filed: Sep. 4, 2002

(65) Prior Publication Data

US 2003/0168419 A1 Sep. 11, 2003

Related U.S. Application Data

(63) Continuation-in-part of application No. 29/156,774, filed on Mar. 8, 2002, now Pat. No. Des. 485,157.

(51) Int. Cl.[7] ..... A47F 5/00
(52) U.S. Cl. ..... 211/59.1; 211/57.1; 248/214
(58) Field of Search ..... 211/57.1, 106, 211/59.1, 70.2; 248/214, 215

(56) References Cited

U.S. PATENT DOCUMENTS

| | | | | |
|---|---|---|---|---|
| 43,289 | A | | 11/1864 | Sternau |
| 177,936 | A | | 5/1876 | Haines |
| 565,525 | A | | 8/1896 | Tucker |
| 1,998,243 | A | | 10/1935 | Krueger |
| 2,706,049 | A | * | 4/1955 | Andrews |
| 3,411,633 | A | | 11/1968 | Magnuson |
| 4,372,450 | A | | 2/1983 | Licari et al. |
| D291,031 | S | | 7/1987 | Luongo |
| D291,154 | S | | 8/1987 | Owen |
| 4,834,248 | A | | 5/1989 | Lee |
| 5,014,948 | A | * | 5/1991 | Asaro et al. ..... 245/215 |
| 5,246,190 | A | * | 9/1993 | Swirkal ..... 248/100 |
| D355,841 | S | | 2/1995 | Goodman et al. |
| D378,252 | S | | 3/1997 | Smith |
| 5,833,077 | A | * | 11/1998 | Engel ..... 211/59.1 |
| 6,029,827 | A | * | 2/2000 | Valiulis ..... 211/59.1 |
| 6,189,847 | B1 | * | 2/2001 | Hart |
| 6,193,079 | B1 | * | 2/2001 | Wiemer ..... 211/59.1 |
| 6,389,722 | B1 | * | 5/2002 | Josefsson et al. ..... 211/57.1 X |
| 6,604,637 | B2 | * | 8/2003 | Lane et al. ..... 211/59.1 |

* cited by examiner

*Primary Examiner*—Robert W. Gibson, Jr.
(74) *Attorney, Agent, or Firm*—Birch, Stewart, Kolasch & Birch, LLP

(57) ABSTRACT

A hanger for merchandise to be displayed on a stand. The hanger includes a vertical back plate and hooks which can be placed on a stand made of horizontal rods. Merchandise holders extend forwardly from the back plate and receive merchandise thereon. The merchandise can be placed on the hanger at the manufacturing end, so that the store owner can easily fill a display stand by placing only a few hangers on the stand.

10 Claims, 7 Drawing Sheets

MERCHANDISE HANGER

CROSS-REFERENCE TO RELATED APPLICATIONS

This is a continuation-in-part application of Design application Ser. No. 29/156,774, filed Mar. 8, 2002; now U.S. Pat. No. D,485,157 the entire content of which is hereby incorporated by reference.

BACKGROUND OF THE INVENTION

1. Field of the Invention

This invention relates generally to a hanger for holding merchandise which may be placed on a display rack and more particularly, to a merchandise hanger which is integrally formed and which has a pricing bar.

2. Description of the Background Art

It is important in selling merchandise to display the items for sale in an attractive and convenient manner. This is especially important for items which have a relatively low price and for which the purchase decision is made on the spot. That is, the item is not one which the customer came to buy, but which appeals to the buyer after seeing it in the store. This is true for inexpensive items which are available in certain supermarkets, food stores, drug stores, variety stores, mass merchants and other similar stores where the customer may be purchasing other items but will be attracted to an item because of its utility and packaging after it is seen on display.

Various kinds of displays are available for this merchandise, including counter displays which are essentially a cut-away box sitting on a counter or shelf, a floor stand, which is a larger box set on a pedestal and various types of vertically arranged racks onto which merchandise is placed with hooks. These arrangements are sometimes called "power panels" or "sidekicks" and are often used in various kinds of stores to display any number of small lightweight items. This display consists of some type of stand or support and some type of grid work onto which the merchandise may be placed. For example, the panel may stand about four feet tall, and may be to twelve to eighteen inches wide. A series of horizontal rods may extend from side-to-side and are spaced from each other vertically, for example by three quarter of an inch. Other similar type of arrangements are also available which have a pegboard backing.

Various arrangements of hooks and merchandise are available which can be hung on the floor stand device. One type is a hook which has a vertical metal back and a frontwardly protruding chrome wire which extends forward by four to six inches and then angles upwardly. The back plate has hooks at the top portion which extend over one of the horizontal rods and a bottom section which then snaps over the next horizontal rod. When used in a pegboard configuration, the back plate may have pegs which interact with holes in the peg board. This type of well known hook is widely used, but has the disadvantage that a great deal of effort is necessary in order to mount all the hooks and to place the merchandise on the hooks by the store owner. While the merchandise could be preloaded onto the hook, the snapping action of the hook onto the stand makes such an assembly more difficult. Further, because of the number of hooks, even if this is possible, a relatively large amount of time is necessary in order to fill the floor stand.

Another approach to this problem is to provide an entire cardboard sheet with the merchandise pre-mounted on the sheet so that the store owner merely places the entire assembly onto the floor stand. This reduces the amount of work for the store owner but is relatively expensive, especially when the merchandise items are inexpensive items. For example, providing a cardboard sheet with hooks may cost on the order of $10–$15 for one stand. If the items for sale are inexpensive items which cost only a $0.50 per piece and the entire stand only holds fifty items, the cost of the cardboard and hook arrangement is a large percentage of the sales price of the items.

The prior art includes any number of other racks for holding merchandise and other items utilizing a vertical plate and extending hooks or pegs onto which the items are placed. Examples of this are shown in U.S. Pat. Nos. 4,834,248, 4,372,450, 3,411,633, 1,998,243, 565,525, and 177,936, and Design Patent Nos. 355,841, 291,154, 291, 031, 378,252 and 43,289. However, this prior art does not solve the problems of easy handling of merchandise to be stored on a display rack.

SUMMARY OF THE INVENTION

Accordingly, one object of the present invention is to provide a merchandise hook which is easily mounted on a vertical stand.

Another object of this invention is to provide a merchandise hook which is inexpensive to make.

Another further object of this invention is to provide a merchandise hook which is inexpensive to make and easy to insert onto a stand.

A still further object of this invention is to provide a merchandise hook which may be filled for easy installation on a rack.

A still further object of this invention is to provide a merchandise hook which is integrally formed and which covers substantially all of the width of a stand.

Briefly, these and other objects of the invention are achieved by providing a hook arrangement which has a vertical back plate extending across substantially the entire width of the rack with hooks extending upwardly from the back plate to hang the unit on the rack and a series of forwardly extending merchandise holders onto which the merchandise may be pre-loaded.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
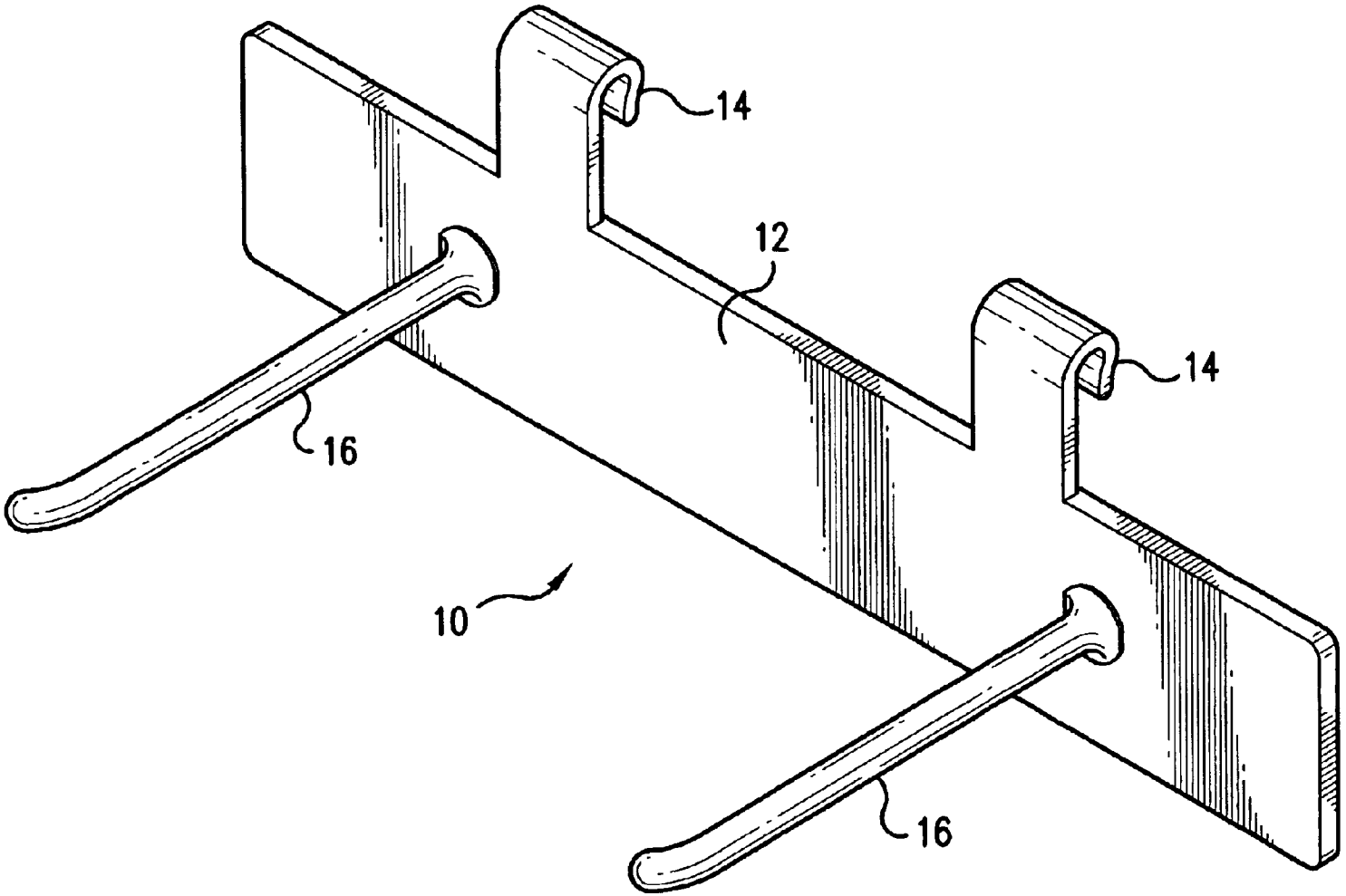
FIG. 1 is a perspective view of a first embodiment of the present invention.

Referring now to the drawings wherein like reference numerals designate identical or corresponding parts in the several views and more particularly, to FIG. 1 thereof, wherein a first embodiment of the merchandise hanger of the present invention is shown by reference numeral 10. The hanger 10 includes a vertical back wall 12 having two hooks 14 for attaching the hanger to the display stand. Frontwardly projecting merchandise holders 16 extend outwardly from the vertical wall plate. The holders 16 may be approximately horizontal with the ends turned up slightly to prevent the merchandise from falling off. Alternatively, the holders may be angled slightly upwardly, if desired.

The hooks 14 are large enough to receive the horizontal rods of the display stand. The opening of the hook has a slightly reduced dimension in the front to back direction to help prevent the hanger from falling off the horizontal rod of the display stand. However, it would also be possible for the back side of the hook to extend directly downwardly without having this reduced dimension.

The hanger is preferably made of a plastic material so that it may be molded in a single operation. This reduces costs and makes the manufacturing easier. However, it also may be possible to manufacture the holders 16 in a separate operation and separately attach them to the back plate. Also, it would also be possible to make the device of a different material, such as metal, if desired.

Figure 2:
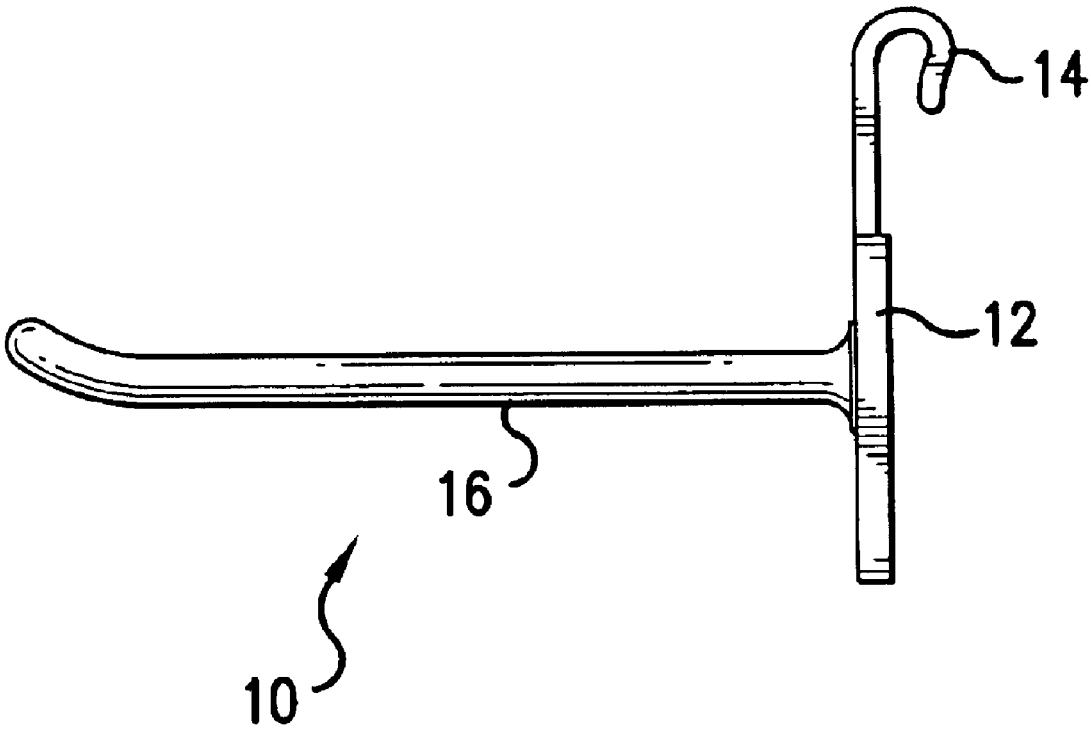
FIG. 2 is a side view of the first embodiment of the present invention.

FIG. 2 shows the same device 10 from the side showing the shape of the back of the hook more clearly.

While the back plate 12 is shown as being a solid piece of material, it would also be possible for the back side to be partially removed and replaced with ribbing to increase its strength. This would reduce the weight of the device and make it less expensive to manufacture.

In operation, a manufacturer places the merchandise on the holders 16 and places them in a box with enough other similar units to fill a display stand. Upon receipt, the store owner opens the box and places each of the merchandise hangers with the attached merchandise directly onto the display stand. The width of the hanger is substantially equal to the width of the display stand so that one hanger fills a large portion of the stand. Depending on the size of the merchandise being sold, several hangers can be arranged vertically to cover the entire stand. Thus, if the stand is roughly four feet tall, and the vertical dimension of one hanger and the merchandise which hangs therefrom is eleven inches, four hangers may be placed on the stand with a one inch spacing. Also, it is not necessary for the hanger to extend completely from one side of the stand to the other. That is, the merchandise may extend beyond the edge of the hanger on each side. The merchandise holder 16 must be spaced far enough from the edge of the hanger so that it is fully supported, but the merchandise itself may be considerably wider. If the stand is very wide, more than one hanger may be used to cover the width.

Figure 3:
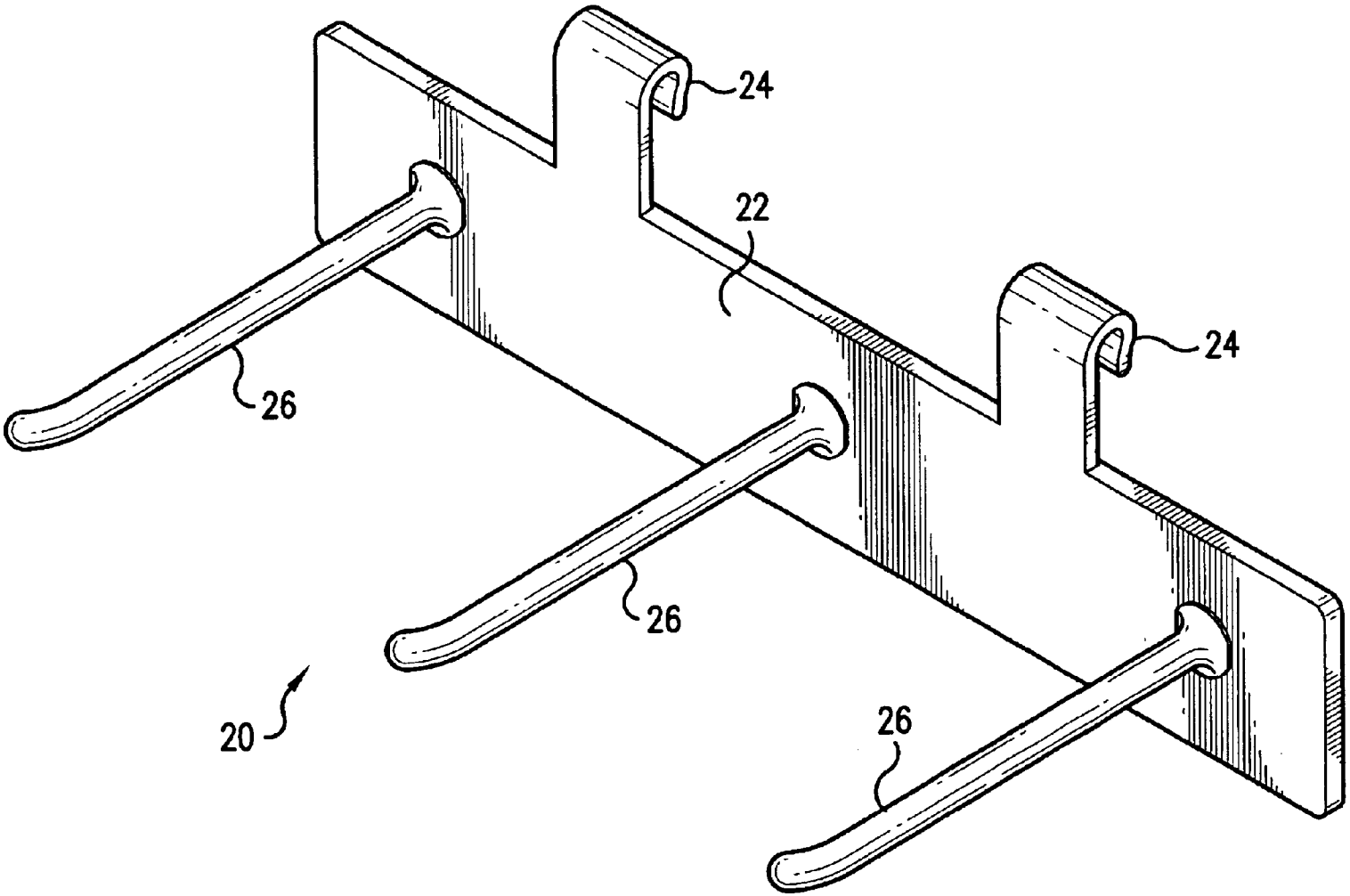
FIG. 3 is a perspective view of a second embodiment of the present invention.

FIG. 3 shows a second embodiment 20 of the present invention, where three merchandise holders 26 extend from back plate 22. Two hooks 24 extend upwardly from the back plate.

Figure 4:
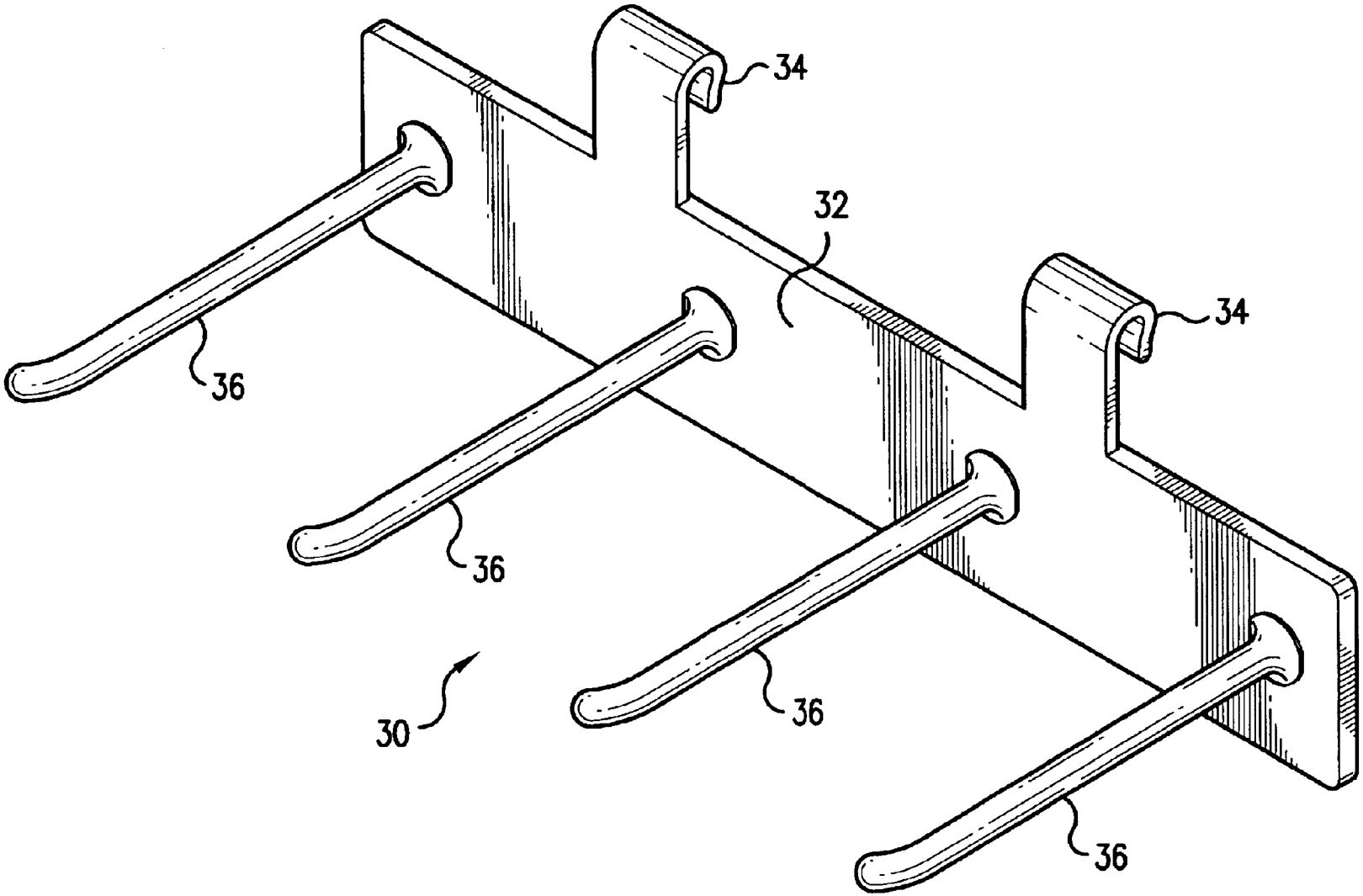
FIG. 4 is a perspective view of a third embodiment of the present invention.

FIG. 4 shows a third embodiment 30 of the present invention which has four merchandise holders 36 extending forward from a back plate 32. Two hooks 34 extend upwardly in the same fashion as the other embodiments. The second and third embodiments act in a similar fashion to the first embodiment but have additional merchandise holders extending therefrom. The number of holders which are present in the hanger is determined by the size of the merchandise being sold. Also, while each of the hangers is shown as having two hooks, any number of hooks could be utilized with additional hooks being desirable for heavier items. However, for most items, two hooks is sufficient.

In each of these embodiments, the hooks form a simple solution to holding the merchandise in place. That is, it is only necessary to extend the hooks over the rod and allow the weight of the hanger and merchandise to hold it in position. This avoids the necessity of having to snap or otherwise attach the hooks to the stand which not only takes more time, but is likely to dislodge the merchandise from the holders.

It would also be possible to have embodiments where a single holder extends forward from the back plate and may either utilize the same hook arrangement or could utilize a single hook which is in line with the single holder. Likewise, any number of additional holders could also be present if the size of the merchandise allows this. It would also be possible to extend the vertical dimension of the back plate in order to accommodate a second row of hooks which would either be in line with the first row or offset if the size of the merchandise allows it.

Figure 5:
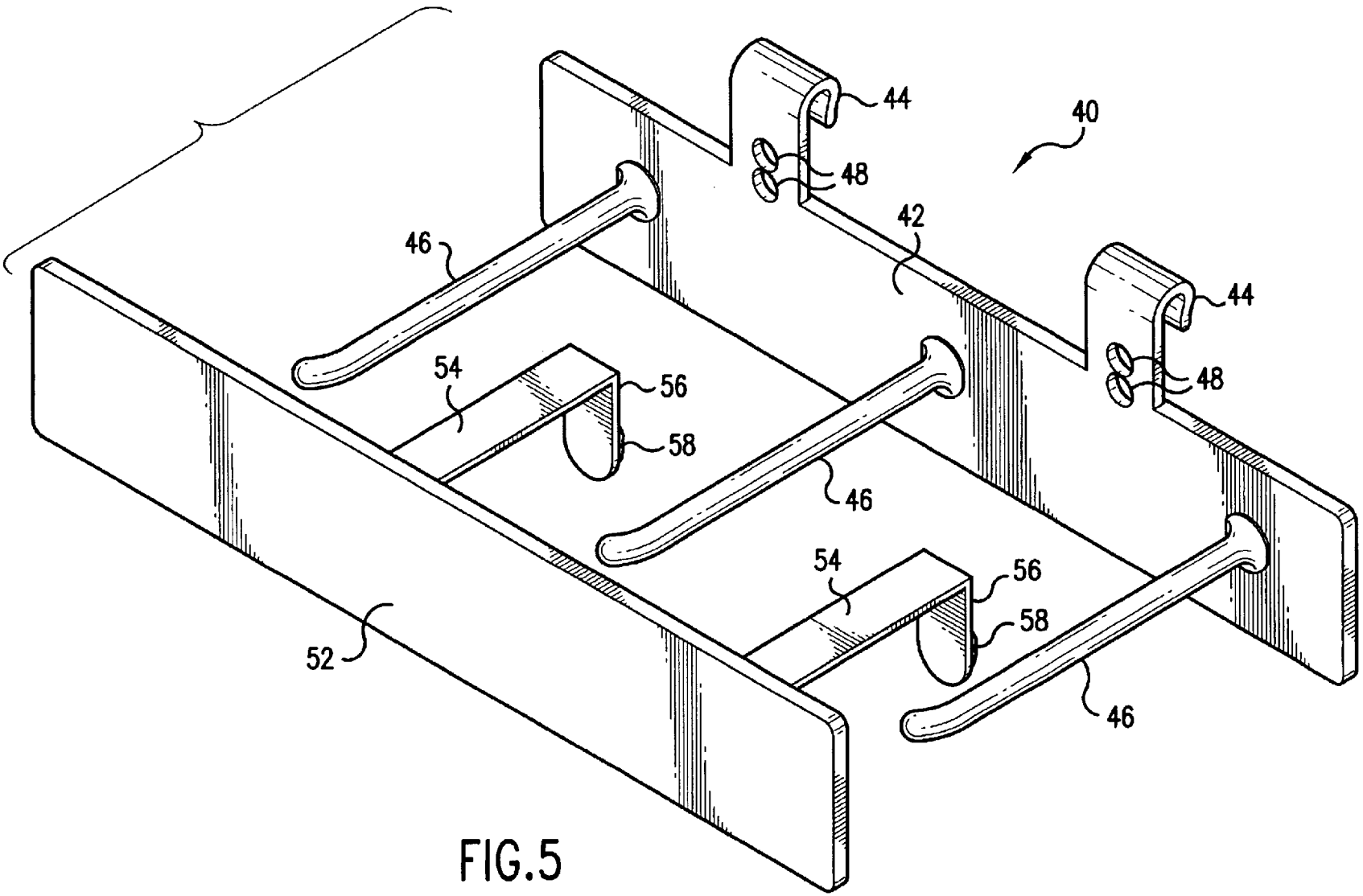
FIG. 5 is a perspective exploded view of the fourth embodiment of the present invention.
Figure 6:
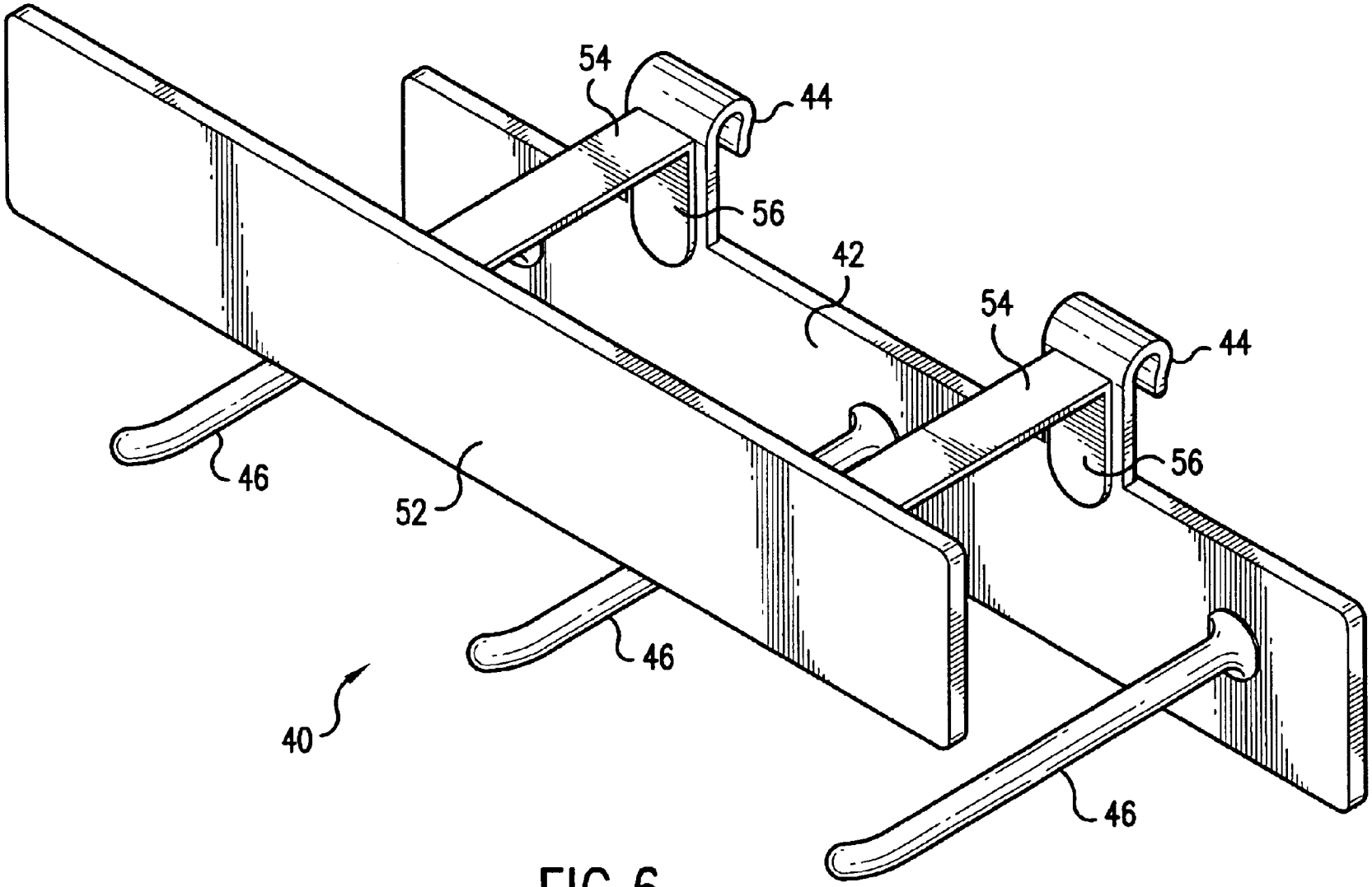
FIG. 6 is a perspective view of the fourth embodiment of the present invention.
Figure 7:
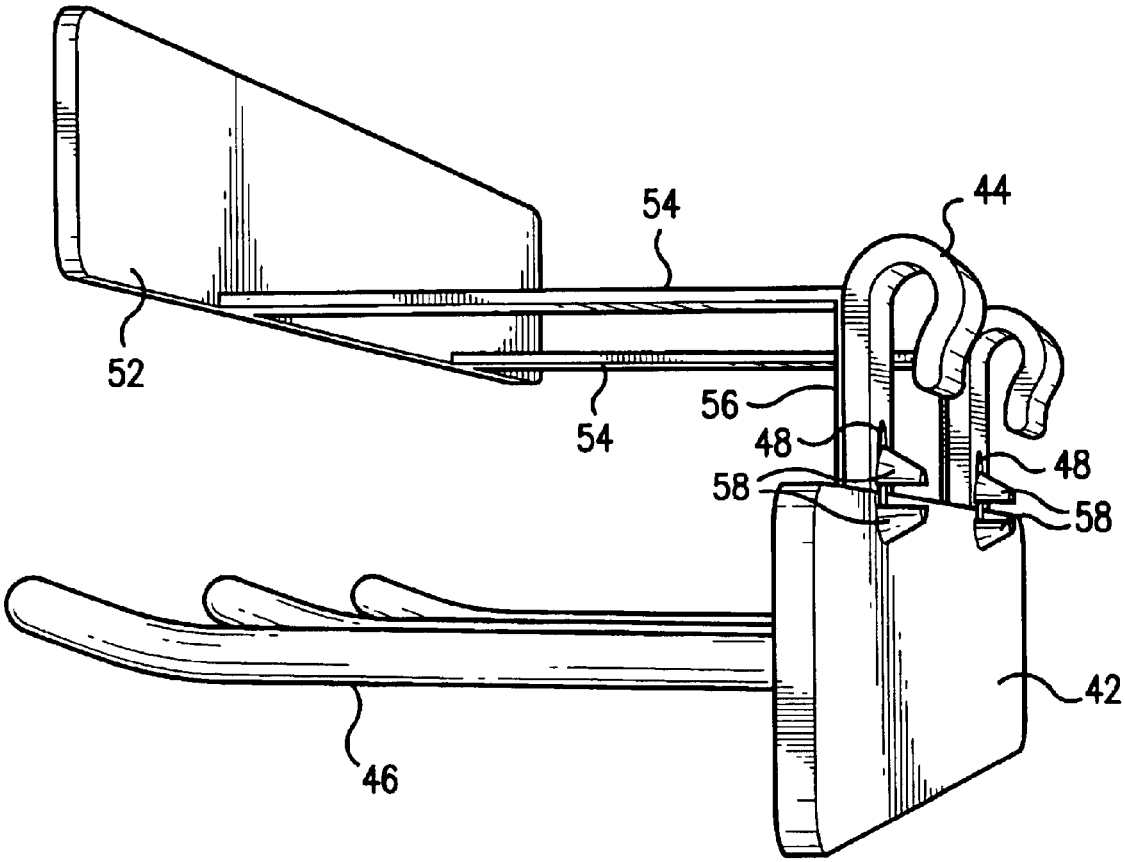
FIG. 7 is a rear view of the fourth embodiment of the present invention.

FIGS. 5–7 show a fourth embodiment 40 of the present invention. In this embodiment, the hanger utilizes a pricing bar on which can be located information regarding the price, size, quality, manufacturer, etc. of the merchandise. The hanger includes a back plate 42 with frontwardly extending holders 46 and hooks 44 for holding a basic unit to the display stand. This is very similar to the embodiment shown in FIG. 3. Other embodiments having a different number of holders could also be used. However, in addition, holes 48 are provided on the hook portion of the hanger for receiving the pricing bar. These holes may be placed in any arrangement, either vertically as shown or horizontally if desired, or may be included on the back plate rather than on the hooks. Any number of holes may be used, as long as the attachment is firm.

The pricing bar includes a front plate 52 for receiving the pricing information. This bar may merely provide a flat surface to which adhesive labels may be attached which include the various information about the product. Alternatively, horizontally extending slots may be added to the top and bottom of the front plate so that a card type display may be inserted into the slots. The front plate extends forwardly from the basic hanger unit using support bars including a frontwardly extending section 54 and a downwardly extending section 56. Projections 58 are mounted on the downwardly extending section to attach the pricing bar to the hanger by inserting the projections into openings 48.

FIG. 6 shows the pricing bar and hanger connected as in actual operation. FIG. 7 shows the same arrangement from the back to better show the insertions of the projection 58 into openings 48. The projection 58 may assume any shape which is flexible enough to be inserted into an opening and to latch into position thereby. The projections shown are generally conical in shape and are made of soft enough plastic that they may be inserted into the projection and hold the pricing bar in position. Other shaped projections may also be utilized including projections which are larger on the outer end and have a narrower section which extends through the hole. The outer ends may also have slots cut therein to allow them to be more flexible when going through the opening. The shape of the larger end may be conical, pyramidal or spherical or any other shape as desired. In place the opening and projection arrangement, it would also be possible for the pricing bar to be connected to the hanger by other means such as Velcro, adhesive or by using a fastener.

In operation then, this device operates similar to the other embodiments in that the pricing bar could be added to the merchandise hanger before being loaded and placed in the box and the hanger could then be placed on the display stand in the same manner. Alternatively, the pricing bar could be added afterwards at the store. The price information could also be added at the store if desired.

Numerous additional modifications and variations of the present invention are possible in light of the above teachings. It is therefore to be understood that within the scope of appended claims, the invention may be practiced otherwise and is specifically described herein.

What is claimed is:

1. A merchandise hanger for holding merchandise on a display rack, comprising;

a vertically oriented back plate;

at least one hook attached to said back plate for extending over part of said display stand to support said hanger thereby;

at least one merchandise holder extending forwardly from said back plate for receiving said merchandise thereon;

a pricing bar mounted on said merchandise hanger to display product information, said pricing ba including projections and said merchandise hanger including holes for receiving said projections to hold said pricing bar in place.

2. The merchandise hanger according to claim 1, wherein said back plate, said hook and id merchandise holder are integrally formed.

3. The merchandise hanger according to claim 2, wherein the hanger is made from plastic material.

4. The merchandise hanger according to claim 1, wherein the merchandise holder extend perpendicular to said back plate with a forward end bent upwardly.

5. The merchandise hanger according to claim 1, wherein the merchandise holder extends from the back plate at an upward angle.

6. The merchandise hanger according to claim 1, comprising two hooks.

7. The merchandise hanger according to claim 1, comprising two merchandise holders.

8. The merchandise hanger according to claim 1, comprising three merchandise holders.

9. The merchandise hanger according to claim 1, comprising four merchandise holders.

10. The merchandise hanger according to claim 1, further comprising an extender for spacing said pricing bar forward of said back plate.

* * * * *